US006021751A

United States Patent [19]

Spath

[11] Patent Number: 6,021,751

[45] Date of Patent: Feb. 8, 2000

[54] HYDRAULIC VALVE LIFTER WITH LASH

[75] Inventor: Mark James Spath, Spencerport, N.Y.

[73] Assignee: General Motors Corporation, Detroit, Mich.

[21] Appl. No.: 09/252,143

[22] Filed: Feb. 18, 1999

[51] Int. Cl.[7] ..... F01L 1/25

[52] U.S. Cl. ..... 123/90.55; 123/90.19; 123/90.46

[58] Field of Search ..... 123/90.19, 90.35, 123/90.43, 90.46, 90.48, 90.49, 90.55, 90.36

[56] References Cited

U.S. PATENT DOCUMENTS

| | | | |
|---|---|---|---|
| 2,908,260 | 10/1959 | Bergmann, Sr. | 123/90.57 |
| 2,937,632 | 5/1960 | Voorhies | 123/90.36 |
| 2,941,523 | 6/1960 | Bergmann | 123/90.57 |
| 2,942,595 | 6/1960 | Bergmann, Sr. et al. | 123/90.57 |
| 3,542,001 | 11/1970 | Line | 123/90.43 |
| 4,977,867 | 12/1990 | Rhoads | 123/90.49 |
| 5,586,528 | 12/1996 | Speil | 123/90.51 |

*Primary Examiner*—Weilun Lo
*Attorney, Agent, or Firm*—Vincent A. Cichosz

[57] ABSTRACT

A hydraulic valve lifter for use between a cam and a valve in an engine valve train includes a hydraulic lash adjuster element of varying length for acting in the valve train between the cam and valve, an expansion spring for extending the length of the lash adjuster to take up lash in the valve train between valve opening events, and a lash spring stronger than the expansion spring but weaker than a valve spring of an associated engine valve. The lash spring biases the adjuster element against the expansion spring and shortens the effective lash adjusting length of the valve lifter a small amount to maintain a sufficient amount of lash in the valve train between valve opening events to prevent holding open of the valve during cold engine operation. Various embodiments are disclosed.

12 Claims, 3 Drawing Sheets

HYDRAULIC VALVE LIFTER WITH LASH

TECHNICAL FIELD

This invention relates to hydraulic valve lifters for taking up lash in the valve trains of engines and, more particularly, to valve lifters which retain a small amount of valve lash in the valve train to prevent thermal pump up of the lifter from holding open a valve during cold engine operation after start up.

BACKGROUND OF THE INVENTION

During start up of a cold engine, oil viscosity is high and exhaust valve growth is rapid so that hydraulic elements which use a spring biased plunger may not provide a sufficient leakdown rate to avoid holding the valve off its seat on the cam base circle, a condition sometimes called thermal pump up. This condition may cause improper engine operation or stalling and thus requires correction.

Mechanically lashed valve trains provide sufficient lash to accommodate transient growth of valve train components following start up, but do not have the benefit of automatically compensating for build tolerances and wear over the life of the engine as hydraulic lifters do. Means for correcting the thermal pump up problem while retaining the benefits of hydraulic valve lifters are accordingly desired.

SUMMARY OF THE INVENTION

The present invention provides a solution to the cold start thermal pump up problem by adding a sufficient amount of built-in lash to a hydraulic lifter to prevent thermal pump up of the exhaust valves while maintaining the automatic lash compensation function of the hydraulic lifter. This is accomplished by adding a lash spring which shortens the effective length of a hydraulic lash adjusting element in the lifter by a small amount to provide sufficient lash to absorb transient growth of the valve train which exceeds the leakdown rate of the lifter. This prevents holding open of an associated valve during cold engine operation. The lash spring opposes an expansion spring, or plunger spring, in the lash adjusting element. Thus it must be stronger than the expansion spring but weaker in operation than the valve spring of an associated valve. The opening motion of the valve lifter first causes compression of the lash spring to take up the lash, after which trapped hydraulic fluid in the lash adjuster provides a solid link for opening the valve.

During steady state operation, the lash spring introduces a fixed amount of mechanical lash into the valve train which must be closed prior to valve opening. In nonsteady state transient operations, such as during engine start up, the amount of mechanical lash may be reduced when growth of the valve train components exceeds the leak down rate of the hydraulic lash adjusting element. However, as long as the amount of mechanical lash is adequate to absorb the excessive growth of the valve train components, opening of the valve due to thermal pump up is prevented and, as the engine warms up and a normal leakdown rate of the hydraulic lash adjusting element is reached, operation with a fixed amount of mechanical lash returns.

The amount of mechanical lash must be introduced or selected for each differing engine application. A cam profile incorporating modified ramps may be required in order to provide proper operation when a steady state condition has been achieved.

These and other features and advantages of the invention will be more fully understood from the following description of certain specific embodiments of the invention taken together with the accompanying drawings.

DESCRIPTION OF THE PREFERRED EMBODIMENT

Figure 1:
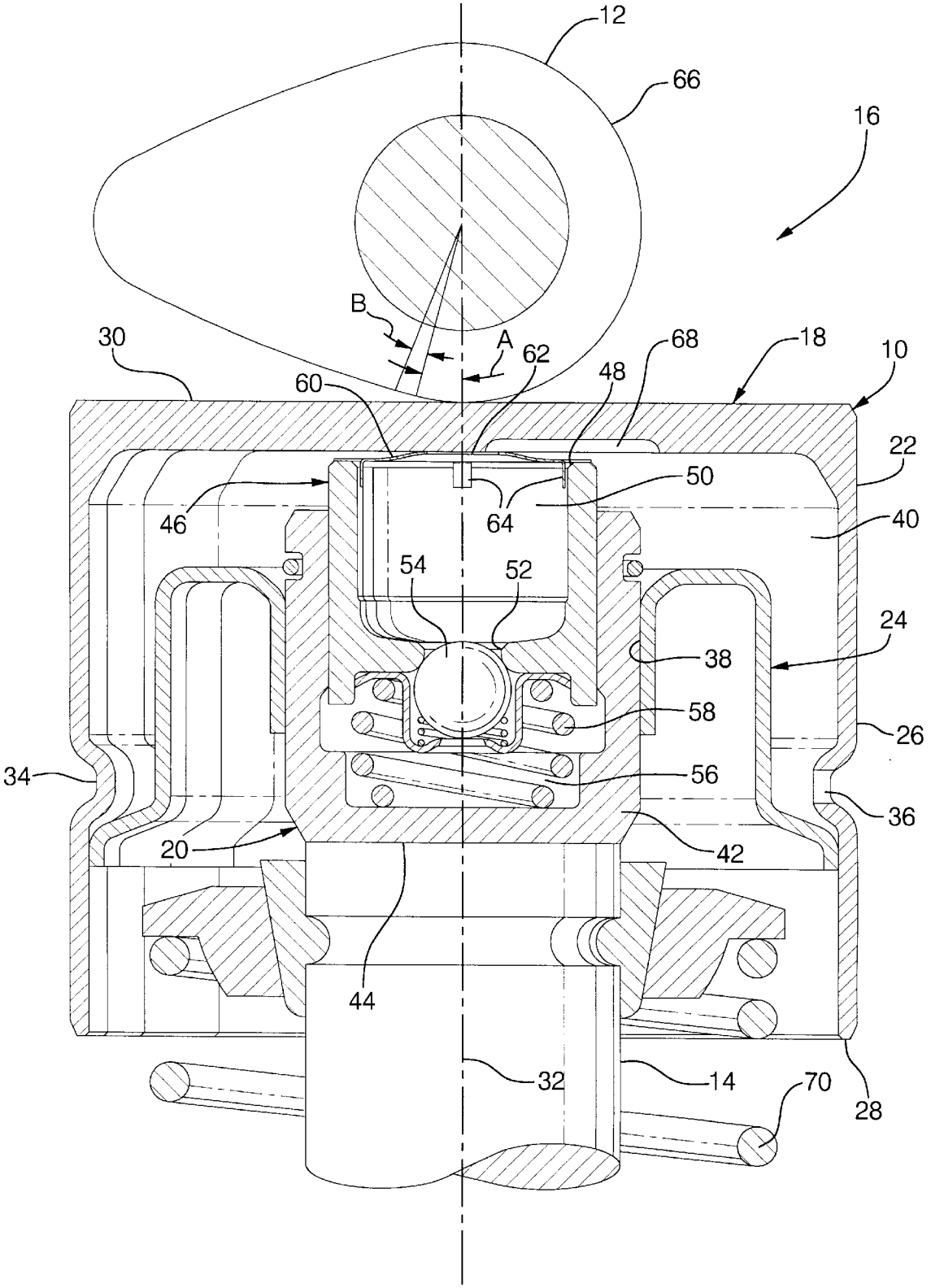
FIG. 1 is a cross-sectional view of an engine valve train incorporating a direct acting hydraulic valve lifter including a lash spring according to the invention.

Referring now to FIG. 1 of the drawings in detail, numeral 10 generally indicates a first embodiment of direct acting hydraulic valve lifter according to the invention. Lifter 10 is somewhat similar in its general construction to tappets or lifters described in prior U.S. Pat. Nos. 4,745,888 and 5,119,774, and is adapted to be reciprocably mounted between a cam 12 and a stem 14 of a cylinder poppet valve of an engine 16 in a conventional manner as shown, for example, in the cited patents.

The lifter 10 comprises a cam follower 18 and a hydraulic element assembly 20. The follower 18 includes a cup like outer shell 22 and an inner baffle 24.

The shell 22 has an annular skirt or outer wall 26 with an open bottom end 28 and a cam engaging head forming a closed upper end 30. The shell outer wall 26 is of circular cross section and centered on an axis 32, however, it may be oval, rectangular or another suitable shape, if desired. Between its ends, the wall 26 has an inwardly extending annular groove 34 having one or more oil inlet openings 36 passing through the shell.

The baffle 24 is retained in a central portion of the shell and includes a portion defining an inner cylinder 38 centered on the axis 32. The baffle 24 extends outward from the cylinder portion 38 to engagement with the outer wall 26 below the groove 34 to define an enclosed annular first space 40 between the baffle and the closed upper end 30.

The hydraulic element assembly 20 includes a hollow piston 42 reciprocably guided in the inner cylinder 38 and having a closed end 44 facing away from the closed end 30 of the shell. Internally, the piston 42 carries a reciprocable plunger 46 having an open end 48 that is operatively engagable with the closed end 30 of the shell in a manner to be subsequently described. Internally, the plunger defines a reservoir or low pressure chamber 50 having at its lower end an orifice 52 controlled by a check valve 54 and connecting with a high pressure chamber 56 located within the lower end of the piston 42. A compression plunger spring 58, located within the high pressure chamber 56, acts between the closed end 44 of the piston and the plunger 46 to bias the plunger toward engagement of the closed end 30 of the shell 22.

Mounted on the open end 48 of the plunger 46 is a lash spring 60 formed as a modified belleville spring or belleville washer having a generally domed annular body with its periphery resting upon the edges of the plunger open end 48 and having a central opening 62. Locating tabs 64 extend downward at spaced points around the periphery to engage the inner surface of the plunger open end to locate the lash spring in position on the open end of the plunger. The lash spring 60, in assembly, is stronger than the plunger spring 58 so that the lash spring holds the open end of the plunger away from engagement with the closed end 30 of the shell while the cam 12 engages the valve lifter on its base circle portion 66 of the cam.

In operation, the hydraulic valve lifter 10 is mounted in a bore of a tappet gallery, not shown, of engine 16. Pressurized oil is provided from the engine tappet gallery to the groove 34 and through opening 36 to the annular first space 40 within the lifter. The oil is directed through a recess 68 in the closed end 30 of the shell 22, through the opening 62 in the belleville type lash spring and into the low pressure chamber 50 within the plunger 46. From there, oil is fed through the check valve controlled orifice 52 into the high pressure chamber 56 where it is prevented from escaping by the check valve and thus is trapped, except for leakage through a close clearance between the plunger 46 and the hollow piston 42 within which the plunger is reciprocably received. The clearance is specifically selected to provide a controlled amount of leakdown or flow of oil from the high pressure chamber during valve opening operations to be subsequently described. The leakdown rate must be great enough to accommodate transient changes in valvetrain growth under normal engine operating temperatures and conditions.

At normal operating conditions, when the cam is rotated, from the base circle location shown in FIG. 1 through an angle A representing a lash ramp, the cam compresses the lash spring 60 until the closed end 30 of the shell effectively engages the open end 48 of the plunger through the peripheral edges of the lash spring itself which is then in a flattened condition. Further rotation of the cam, through the angle B forming a hydraulic cam or ramp, compresses the oil in the high pressure chamber 56 until a force is exerted equivalent to that of the valve spring 70 and the inertia of the valve, so that further rotation of the cam opens the valve in an opening and closing curve as controlled by the cam shape.

During this opening and closing event, the lash spring remains compressed by engagement of the closed end 30 of the shell with the open end 48 of the plunger, which in turn holds open the valve by engagement with the stem 14. During this period of normal operation, a small amount of oil passes through the clearances out of the high pressure chamber 56. Then, when the cam again turns until the base circle 66 contacts the closed end 30 of the shell, the valve is again returned to its seat and the lash spring expands forcing the plunger away from the closed end 30 of the shell. Make up oil is then fed from the low pressure chamber 50 through the check valve orifice 52 into the high pressure chamber 56 until the lash spring 60 is again held against the closed end 30 with a force equal to that of the plunger spring 58 and the hydraulic valve lifter 10 is ready for the next valve opening event.

However, under cold engine conditions, the lubricating oil supplied to the hydraulic valve lifter may be of greatly increased viscosity so that leakage from the high pressure chamber is much less than during normal operating conditions. Under these conditions, rapid growth, particularly in an exhaust valve as it is rapidly heated during operation of the engine, may cause the length of the valve train to increase at a greater rate than leakage of oil from the high pressure chamber 56 can accommodate. Thus, the valve may be held open a small amount when the cam returns to the base circle in a condition called thermal pump up which is detrimental to engine operation and may cause stalling.

The thermal pump up condition is prevented in the embodiment of FIG. 1 by the operation of the lash spring 60 which provides a small amount of mechanical lash in the system by holding the open end 48 of the plunger 46 away from the closed end 30 of the shell when the cam is operating on the base circle. The amount of lash is selected so that any excess thermal growth in the valve train length caused, for example, by heating of the exhaust valve, will be absorbed by the mechanical lash so that the open end of the plunger is held away from the closed end of the shell 22 under all conditions when the cam is operating on the base circle. Therefore, the valve 12 is never held open during operation on the base circle of the cam.

Figure 2:
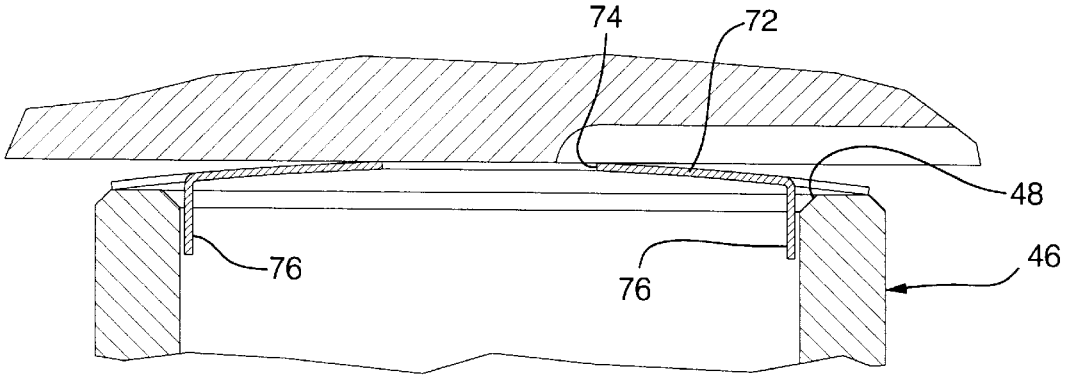
FIG. 2 is a fragmentary cross-sectional view showing an alternative form of lash spring.
Figure 3:
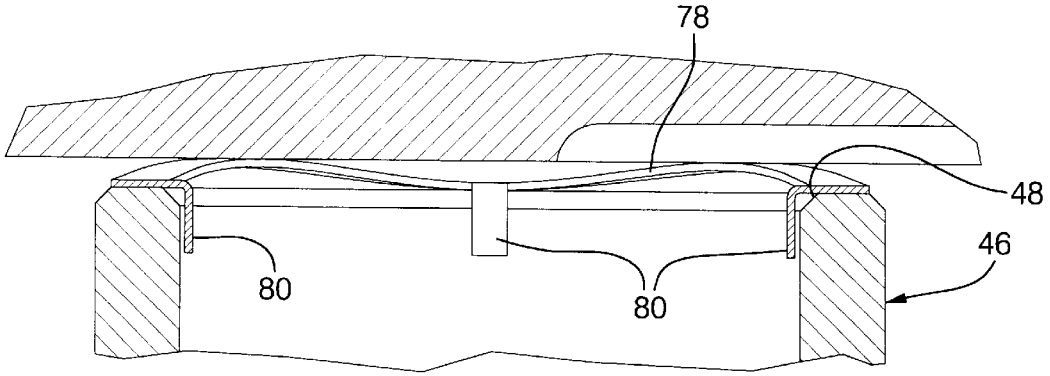
FIG. 3 is a fragmentary cross-sectional view similar to FIG. 2 and showing another alternative form of lash spring.

Referring now to FIGS. 2 and 3, there are shown alternative forms of flat metal lash springs mountable on the end of a plunger as in FIG. 1. Lash spring 72, shown in FIG. 2 is formed as a bent washer having a central opening 74 and locating tabs 76 operating essentially in the manner described for the belleville spring 60. In like manner, lash spring 78, shown in FIG. 3, is in the form of a wave spring having an undulating annular body held against the open end 48 of the plunger and including locating tabs 80 to position the wave spring on the plunger open end.

Figure 4:
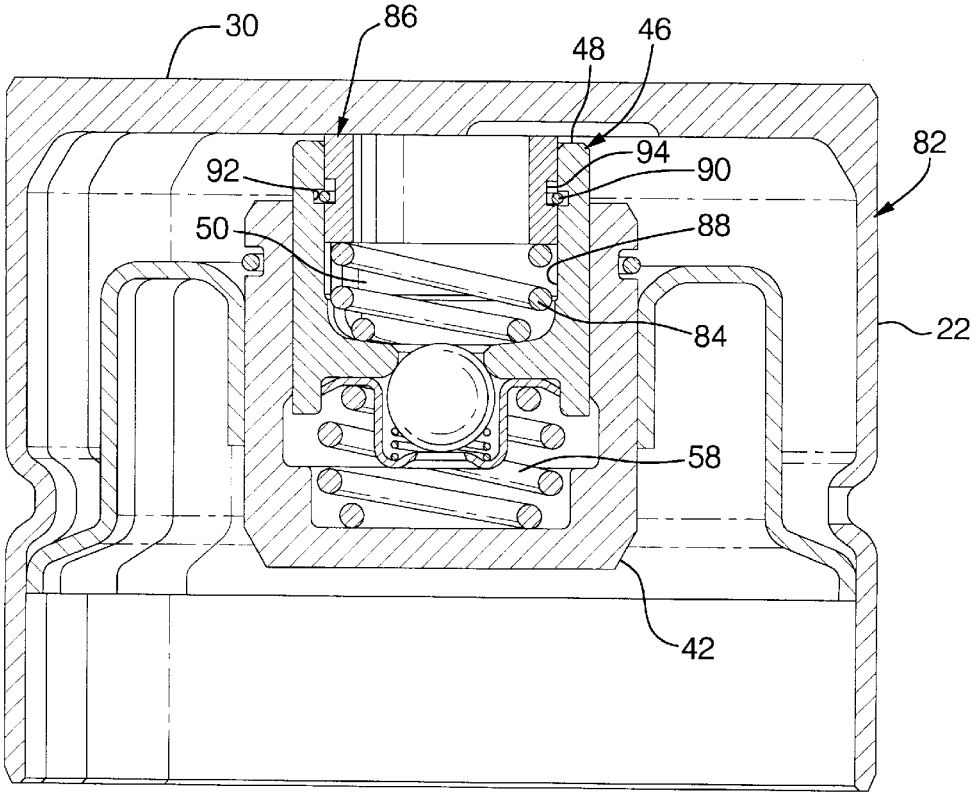
FIG. 4 is cross-sectional view of an alternative embodiment of hydraulic valve lifter incorporating a lash spring and sleeve.

Referring to FIG. 4, there is shown another embodiment of hydraulic valve lifter 82 which is generally similar to lifter 10. However, the lash providing means includes a coil type lash spring 84 and a cylindrical lash sleeve 86. The lash sleeve is mounted for limited reciprocating movement within an internal cylinder 88 defined by the inner surface of the plunger wall forming the low pressure chamber 50. A blind ring 90 seated in a groove 92 in the plunger wall coacts with an axially wider groove 94 in the outer surface of the lash sleeve 86. Thus, a limited motion of the sleeve 86 is allowed between a retracted position wherein its outer end is essentially aligned with the open end 48 of the plunger and an extended position as shown in FIG. 4 wherein the lash sleeve engages the closed end 30 of the shell 22 and holds the open end 48 of the plunger a small distance, or lash offset, away from the closed end 30 of the shell.

The lash spring 84 acts between the plunger and the lash sleeve 86 with a force that is greater than that of the plunger spring and so maintains the lash offset of the plunger at all times when the cam is operating on the base circle, except during conditions of excess growth in the valve train, as previously discussed. In that case, the amount of lash offset will be reduced but not completely closed, and holding of a valve open when the cam is on the base circle will be prevented.

Figure 5:
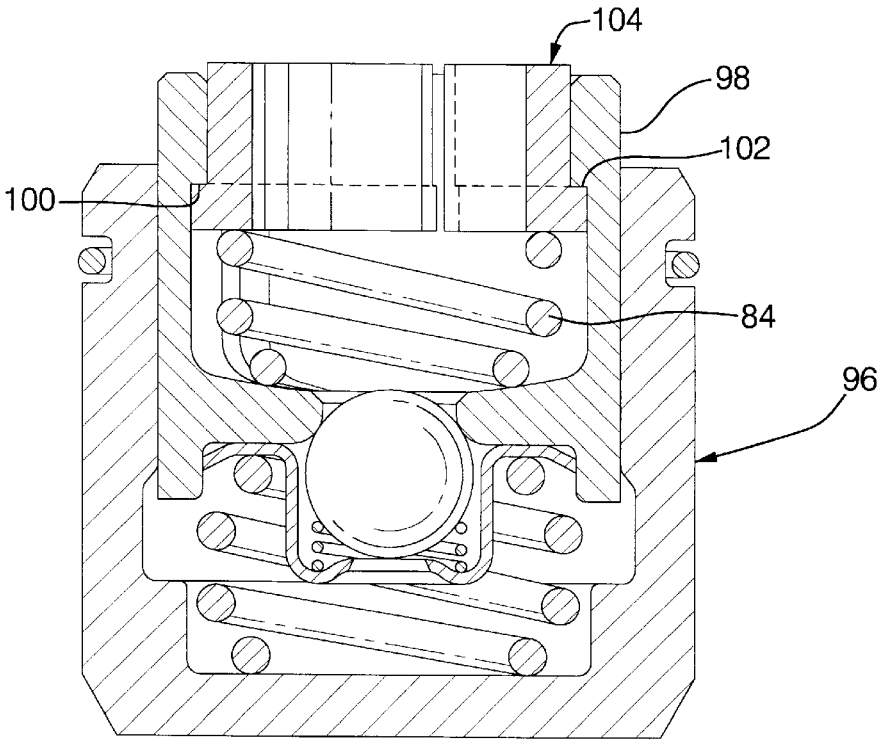
FIG. 5 is a cross-sectional view of a hydraulic element assembly similar to that of FIG. 4 but incorporating a modified form of lash spring and sleeve.
Figure 6:
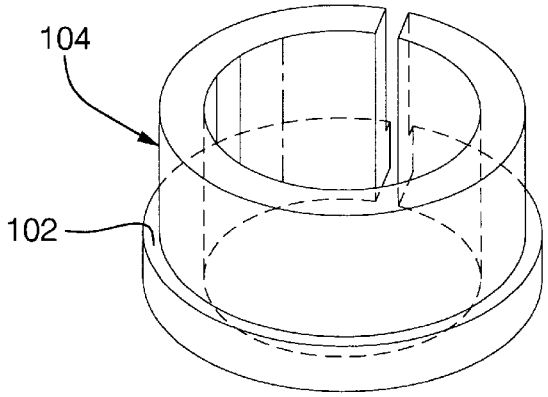
FIG. 6 is a pictorial view of the lash sleeve in the embodiment of FIG. 5.

FIG. 5 discloses an alternate design of hydraulic element assembly 96 having a modified plunger 98 forming an inner abutment 100 which is engaged by a flange 102 of a split ring 104, also shown in FIG. 6. The split ring 104 acts as the lash sleeve and is installable in the plunger by reason of the split which allows the sleeve to be compressed so that the flange can be inserted past the reduced diameter forming the abutment 100. The lash spring 84 engages the modified lash sleeve 104 for operation in the same manner as previously described.

Figure 7:
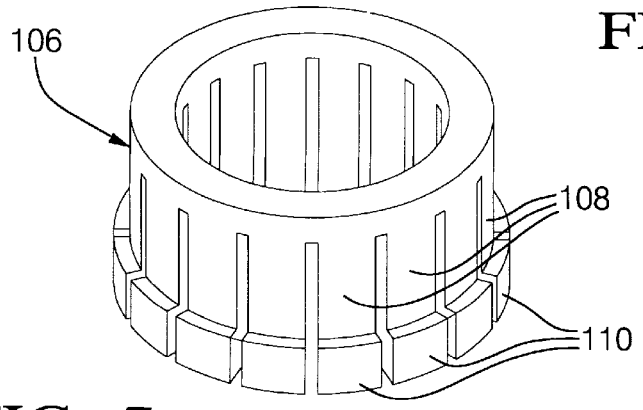
FIG. 7 is a pictorial view of an alternative embodiment of lash sleeve.

FIG. 7 illustrates an alternate form of lash sleeve 106 wherein the ring is solid but is axially slotted at 108 to form a plurality of spring fingers 108. The fingers have radially outwardly extending ends 110 effectively forming a flange like retainer that can be installed in the plunger 98 by springing the fingers inward so that, after installation, the portions 110 may engage the abutment 100 as in the previously described embodiment.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

I claim:

1. A hydraulic valve lifter capable of forming at least a portion of an engine valve train between a cam and a valve, said lifter comprising:

a follower having a cup-like shell with a peripheral outer wall generally parallel with an axis of reciprocation and having closed and open ends, an inner cylinder fixed within said shell parallel with the axis and spaced within the outer wall to define a first space therebetween, a baffle received in said follower shell and extending outward from the inner cylinder toward said outer wall to form, at least in part, a floor for said first space,said first space adapted to receive pressurized hydraulic fluid through inlet opening means in said peripheral outer wall;

hydraulic means in the follower including a hollow piston guided in the cylinder and having a closed end facing away from the closed end of the shell, the closed ends of the shell and piston being adapted respectively for operative association in such valve train with the cam and valve, a plunger guided in the piston and having an open end operatively engagable with the closed end of the shell, the plunger defining a low pressure chamber;

passage means continuously communicating the low pressure chamber with said first space for receiving hydraulic fluid from said first space, the plunger and piston defining a high pressure chamber within the closed end of the piston and connected through a non-return check valve with the low pressure chamber for delivering pressurized fluid to the high pressure chamber, a plunger spring urging the plunger toward engagement with the shell; and a lash spring stronger than the plunger spring but weaker than a valve spring of an associated valve, and disposed between the plunger and the closed end of the shell, the lash spring biasing the plunger against the force of the plunger spring a small distance away from the closed end of the shell when the associated valve is closed to provide lash in the valve train to prevent holding open of the associated valve during cold engine operation.

2. A hydraulic valve lifter as in claim 1 wherein said lash spring is disposed between the open end of the plunger and the closed end of the shell.

3. A hydraulic valve lifter as in claim 2 wherein said lash spring is mounted on the open end of the plunger.

4. A hydraulic valve lifter as in claim 3 wherein said lash spring includes a peripheral edge at least portions of which are seated on the open end of the plunger, said peripheral edge including locating tabs engaging an inner surface of the open end of the plunger to position the peripheral edge thereon.

5. A hydraulic valve lifter as in claim 4 wherein said lash spring is selected from a group consisting of modified belleville springs, wave springs and bent washer springs.

6. A hydraulic valve lifter as in claim 1 wherein the plunger defines an internal cylinder surrounding said low pressure chamber and said lash spring is disposed in said low pressure chamber.

7. A hydraulic valve lifter as in claim 6 and including a lash sleeve slidable within said internal cylinder, said lash spring engaging and biasing the lash sleeve against the closed end of the shell to bias the plunger away from the shell closed end.

8. A hydraulic valve lifter as in claim 7 wherein said lash sleeve is retained within the internal cylinder for movement between slightly extended and retracted positions.

9. A hydraulic valve lifter as in claim 8 wherein said lash sleeve is retained by a split ring engaging grooves in the sleeve and internal cylinder.

10. A hydraulic valve lifter as in claim 8 wherein said lash sleeve is a split ring and is retained by a flange engagable with an abutment within said internal cylinder.

11. A hydraulic valve lifter as in claim 8 wherein said sleeve is a solid ring that is retained by a plurality of integral resilient fingers with radially projecting ends engagable with an abutment within said internal cylinder.

12. A hydraulic valve lifter for use between a cam and a valve in an engine valve train, said lifter including:

a hydraulic lash adjuster element of varying length for acting in the valve train between the cam and valve;

passage means in the lifter continuously communicating the lash adjuster element during operation with a pressurized oil supply;

an expansion spring for extending the length of the lash adjuster to take up lash in the valve train between valve opening events; and a lash spring stronger than the expansion spring but weaker than a valve spring of an associated valve, the lash spring biasing the adjuster element against the expansion spring and shortening the effective lash adjusting length of the valve lifter a small amount to maintain a sufficient amount of lash in the valve train between valve opening events to prevent holding open of the valve during cold engine operation.

* * * * *